US007385879B2

(12) United States Patent
Kibiloski et al.

(10) Patent No.: US 7,385,879 B2
(45) Date of Patent: Jun. 10, 2008

(54) RADIO-CONTROLLED CLOCK

(75) Inventors: Keith Kibiloski, Virginia Beach, VA (US); Charles Wong Tak Chung, Quarry Bay (HK)

(73) Assignee: Equity Industries, Inc., Virginia Beach, VA (US)

( * ) Notice: Subject to any disclaimer, the term of this patent is extended or adjusted under 35 U.S.C. 154(b) by 200 days.

(21) Appl. No.: 11/372,863

(22) Filed: Mar. 10, 2006

(65) Prior Publication Data

US 2006/0153010 A1 Jul. 13, 2006

Related U.S. Application Data

(62) Division of application No. 10/444,568, filed on May 23, 2003, now Pat. No. 7,012,856.

(60) Provisional application No. 60/383,203, filed on May 24, 2002.

(51) Int. Cl.
*G04C 11/02* (2006.01)

(52) U.S. Cl. ..... 368/47; 368/49; 368/52; 368/68; 368/83; 368/241; 368/203; 368/204

(58) Field of Classification Search ..... 368/47, 368/49, 52, 68, 83, 241, 203, 204
See application file for complete search history.

(56) References Cited

U.S. PATENT DOCUMENTS 4,582,434 A 4/1986 Plangger et al.
5,036,500 A 7/1991 Ganter
5,177,714 A 1/1993 Ganter et al.
5,349,570 A 9/1994 Kaiser et al.
5,886,952 A * 3/1999 White ..... 368/10
6,147,935 A * 11/2000 Guyett et al. ..... 368/204
6,219,302 B1 4/2001 Tanoguchi et al.
6,269,055 B1 7/2001 Pikula et al.
7,042,808 B2 * 5/2006 Saitoh ..... 368/47
2004/0160337 A1 * 8/2004 Auyang et al. ..... 340/825.24
2005/0190654 A1 * 9/2005 Patel ..... 368/73
2005/0259518 A1 * 11/2005 Saitoh ..... 368/47

* cited by examiner

*Primary Examiner*—Gary F. Paumen
(74) *Attorney, Agent, or Firm*—Cook, Alex, McFarron, Manzo, Cummings & Mehler, Ltd.

(57) ABSTRACT

A radio-controlled clock (RCC) for receiving and decoding a transmitted time signal to display a precise time in accordance with a time standard. A light emitting diode (LED) display emits sufficient light for easy readability under all lighting conditions, including the time numerals. A signal reception indicator remains lit if the RCC has successfully decoded a time signal. If the time signal is currently being received and decoded, the signal reception indicator flashes. If the decoding is unsuccessful, the signal reception indicator will be unlit until the next decoding attempt. A power transformer to supply current to electronic circuitry contained within in the housing of the RCC is located in the power line cord, as at the plug end, to minimize electromagnetic interference with the decoding of the time signals. A signal strength indicator may have multiple segments to indicate if the received signal is strong, medium, weak or too weak for decoding. Capability is also provided to program a special day, such as a birthday, anniversary, or the like.

16 Claims, 7 Drawing Sheets

FIG.5

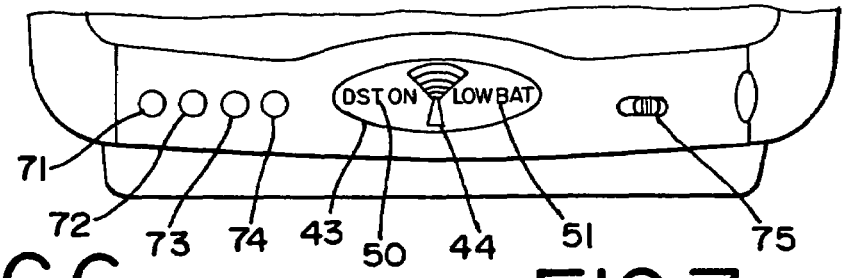

FIG.6

| LOW BACK-UP BATTERY LED INDICATOR | |
|---|---|
| LOW BACK-UP BATTERY | LOW BAT 51 |
| ENOUGH BACK-UP BATTERY | 43 44 |

FIG.7

| RCC RECEPTION LED INDICATOR | | |
|---|---|---|
| RECEPTION MODE | WAVE LED ICON | REMARKS |
| SUCCESSFUL | | ICON STAYS ON |
| RECEIVING | | ICON BLINKS |
| FAILURE | 44 43 | ICON STAYS OFF |

FIG.8

| | LED DISPLAY | SIGNAL STRENGTH |
|---|---|---|
| 65 | 300 | STRONG |
| 66 | 200 | MEDIUM |
| 67 | 100 | WEAK |
| 68 | 000 | NO SIGNAL |

FIG.9

| DST ON-OFF LED INDICATOR | |
|---|---|
| DST ON | 50 DST ON 43 |
| DST OFF | 44 |

FIG.10

| SPECIAL DAY INDICATOR | | | |
|---|---|---|---|
| ENABLE | SPECIAL DAY | LED STAYS ON | 105 |
| ON THE SET DAY | SPECIAL DAY | LED BLINKS | 106 |
| DISABLE | SPECIAL DAY | LED OFF | 107 |

FIG.11

| DAILY / WEEKDAY / WEEKEND ALARM SELECTION | | |
|---|---|---|
| DAILY | ●SUN●MON●TUE●WED●THR●FRI●SAT | 102 |
| WEEKDAY | SUN●MON●TUE●WED●THR●FRI SAT | 103 |
| WEEKEND | ●SUN MON TUE WED THR FRI●SAT | 104 |

RADIO-CONTROLLED CLOCK

CROSS-REFERENCE TO RELATED PATENT APPLICATION

This patent application is a divisional of patent application Ser. No. 10/444,568, filed on May 23, 2003 now U.S. Pat. No. 7,012,856, which is a non-provisional patent application of prior provisional patent application Ser. No. 60/383,203, filed on May 24, 2002, the rights of priority of which are hereby claimed for this patent application.

BACKGROUND OF THE INVENTION

This invention relates in general to clocks that can synchronize to the time of a precise time standard, such as by decoding a low frequency radio signal that contains precise time information. More particularly, a preferred embodiment of the invention relates to clocks of the radio-controlled type that incorporate an improved display for viewing under all typical lighting conditions, that utilize a separate power transformer to reduce electromagnetic interference with a received low frequency radio signal, that provide a visual indication of the status of the received radio signal, and that provide an indication of the relative strength of the received low frequency time signal so that the user can reposition the radio-controlled clock for the best signal reception.

Radio-controlled clocks (RCCs) are known in the prior art, and have been commercially available for some time. RCCs receive and decode a low frequency radio signal that is coded with precise time information. Such clocks are sometimes called "atomic" clocks. However, "atomic" is a misnomer for the radio-controlled clocks that are commercially available to the public because atomic clocks utilize an internal atomic oscillator to keep highly accurate time.

However, the National Institute of Standards and Technology (NIST) operates and maintains a highly accurate atomic clock in Boulder, Colo., USA. The NIST also operates a radio station under the call letters WWVB near Fort Collins, Colo. Radio station WWVB transmits a low frequency radio signal that contains precise time information. The frequency of the radio signal is 60 KHz, well below the lowest frequency available on the standard AM radio broadcast band, i.e., 530 KHz. This radio signal consists of digital bits (ones and zeros) that are created by raising and lowering the transmitted power of the signal once every second. It takes about one minute to transmit a time code consisting of the one-second bits.

This time signal transmitted by radio station WWVB forms the standard for time in the United States and in other North American countries. It is utilized as the time standard by radio and television broadcast networks, by many entities on the internet, and wherever else accurate time is needed or desired. Many individuals also desire to have a clock that provides this highly accurate time.

Radio-controlled clocks satisfy this need by decoding the WWVB time signal and by synchronizing to the current time contained in the signal. RCCs also typically include appropriate hourly adjustments to compensate for differences of time between the different time zones, and for Daylight Savings Time (DST), such that an accurate time is displayed in each time zone where the RCC is used.

RCCs contain an antenna and a radio receiver that is constantly tuned to the 60 KHz frequency of radio station WWVB. Reception of the radio signal can be affected by many factors such as electromagnetic interference and the position of the antenna inside the RCC with respect to the WWVB transmitter at Fort Collins, Colo. As is typical with low frequency radio reception, it is known that this low frequency signal is usually stronger during the evening hours after the sun has set and before the morning sunrise.

Initial synchronization of the time displayed by the RCC to the time code within the WWVB signal typically takes at a couple of minutes, or longer. This is because it takes about one minute to transmit the time code in the signal. Rarely will the RCC be initially powered up to coincide with the beginning of a new time code transmission. Thus, the RCC needs to wait for the next complete time code. Signal reception conditions may also affect how quickly the RCC can decode and display the received time. When synchronization occurs, the time displayed will be accurate to within a fraction of a second. Thereafter, the RCC may seek to decode the WWVB signal only once to a few times per day to confirm that it is still on the correct time, or to correct the displayed time if necessary.

Further background information about NIST, radio station WWVB and RCCs can be found at the internet site http://www.boulder.nist.gov/timefreq/, including the related pages available at this site.

Turning now to the radio-controlled clock, prior art RCCs are known with both analog displays having hour and minute hands, and with digital displays. RCCs with digital displays are generally preferred over the analog displays because the display of the time is generally perceived as more precise. A popular component for a digital display is the liquid crystal display (LCD). However, LCDs are difficult to read in dim lighting conditions, such as are encountered during evening hours, without some form of backlighting. On the other hand, backlighting can be overly harsh to the eyes under the dim lighting conditions of the evening hours.

It is also known that RCCs may experience difficulty in receiving the time signal from radio station WWVB in the presence of electromagnetic radiation. For example, it is commonly recommended that an RCC not be located near a cathode ray tube (CRT) monitor of a computer system. However, those RCCs that operate from an alternating current power system commonly employ a power transformer inside the housing of the RCC. This power transformer also emits electromagnetic radiation, which can potentially interfere with normal operation of the RCC. This power transformer provides operating power to the low frequency receiver and to the other electronics housed within the RCC.

Mentioned above is the not insubstantial amount of time that is required for the RCC to decode the time signal, as well as the risk that the RCC may be unsuccessful due to poor signal conditions, interference, or the like. Prior art RCCs do not generally provide any means to inform the user about the status of the decoding efforts. For example, there is typically no indication whether a recent decoding effort has been successful, or unsuccessful. Similarly, there is no indication when the RCC is currently in the process of decoding a time signal.

There is also no indication of the strength of the received time signal in prior art RCCs. If the user is given knowledge that the received signal is weak, he/she can reposition or relocate the RCC to increase the strength of the received signal, thereby optimizing performance by receiving the best possible time signal.

SUMMARY OF THE INVENTION

The present invention provides several features that overcome the shortcomings of prior art RCCs, as outlined above. A light emitting diode (LED) display emits sufficient light for easy readability under all lighting conditions, including those segments of the display that define the time numerals. A signal reception indicator remains lit if the RCC has recently successfully decoded a time signal. If the time signal is currently being received and decoded, the signal reception indicator continues to flash during the decoding process. This informs the user that the RCC is operating and is currently decoding the time signal. If the decoding is unsuccessful, the signal reception indicator will be unlit until the next decoding attempt.

In accordance with the present invention, a power transformer to supply current to electronic circuitry contained within in the housing of the RCC is located in the power line cord. Preferably, the power transformer forms part of the electrical plug so that the power transformer is located as far from the RCC as possible. Electromagnetic radiation emitted by the transformer is then remote from the electronic circuitry in the housing of the RCC, and the electromagnetic radiation is unlikely to interfere with successfully decoding the time signal.

The instant invention also provides an indication of the received signal strength. This may be implemented by using portions or segments of the display. For example, three illuminated segments of the display could be used to indicate a strong signal, two illuminated segments could indicate a medium strength signal, one illuminated segment could indicate a weak signal, and no illuminated segments could indicate that the signal is too weak to provide reliable information, or that no signal is present. Since decoding of the time signal can typically take a few minutes, the user has sufficient time to relocate or reposition the RCC for better signal reception.

It is a general object of the present invention to provide a radio-controlled clock with improved user features.

It is an object of this invention to provide an improved display for an RCC with readability under all typically encountered lighting conditions.

Another object of the present invention is to provide a visual means of indicating that the RCC is decoding the time signal broadcast by radio station WWVB, or that the RCC has successfully decoded the time signal.

A further object of this invention is to reduce the electromagnetic radiation near the electronic circuitry that decodes the time signal to improve the reliability of the decoding process.

Yet another object of the present invention is to provide the user of the RCC with an indication of the received signal strength so that the user may relocate or reposition the RCC for better signal strength.

Yet a further object of the present invention is to provide an RCC that is programmable for a special day, such as a birthday, anniversary, or the like, and that provides a distinctive reminder, such as an audible sound or a visual indication, when the special day arrives.

These and other objects, features and advantages of the present invention will be better understood in connection with the following drawings and description of the preferred embodiments.

BRIEF DESCRIPTION OF THE DRAWINGS

FIG. 5 is a partial front elevational view of the RCC illustrated in FIGS. 1 through 4 with a front panel removed to show various control buttons and switches;

FIG. 6 is a pictorial diagram illustrating a battery indicator;

FIG. 7 is a pictorial diagram illustrating the various operating states of a signal reception indicator;

FIG. 8 is a pictorial diagram illustrating the various operating states of a signal strength indicator;

FIG. 9 is a pictorial diagram illustrating the various operating states of a Daylight Savings Time indicator;

FIG. 10 is a pictorial diagram illustrating the various operating states of a special day indicator;

FIG. 11 is a pictorial diagram illustrating the various operating states for the alarm selections on weekdays, weekends, or both;

DETAILED DESCRIPTION OF THE INVENTION

Figure 1:
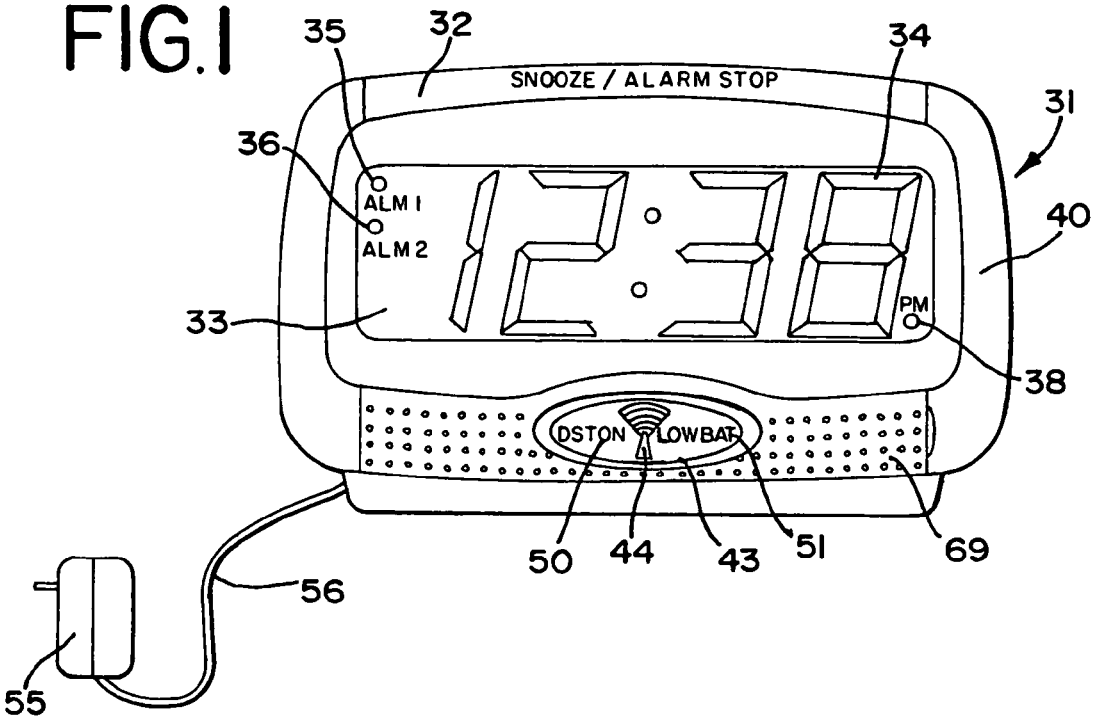
FIG. 1 is a front elevational view of a radio-controlled clock that incorporates features of the present invention.

The various drawing figures will now be referred to in detail. Turning first to FIG. 1, a radio-controlled clock (RCC) is generally designated 31. RCC 31 is of the alarm type, and is provided with a snooze/alarm stop button 32 to terminate and temporarily reset any alarm. Pressing button 32 during an alarm will reset the alarm to again occur at a later time, such as five to ten minutes later. Preferably the reset alarm time will be about nine minutes later.

RCC 31 also has a display 33 to display the time, such as by a plurality of digital numerals 34. In this embodiment, the digital numerals 34 may be of a larger, easier to read size, such as 1.8 inches (4.57 centimeters) in height.

The indicia on display 33, including the time numerals 34, are preferably of the light emitting diode (LED) type. For example, LED display 33 may be of the "high red" type that is also known in the industry as a GaAlAs LED display. Displays of the LED type provide excellent visibility under most lighting conditions encountered, such as those lighting conditions commonly found in home or office environments. As an example, LED displays are easily readable at night without the assistance of backlighting as is normally required in dim lighting conditions for displays of the liquid crystal display (LCD) type. A rotary dimmer switch 39 may be disposed through housing 41 on the backside of RCC 31 to provide control of the brightness of LED display 33 at any selected brightness level between maximum and minimum levels. Dimmer switch 39 may have fixed settings, such as high and low, or may be variable between high and low positions.

Display 33 has two indicators 35 and 36, alarm 1 and alarm 2, respectively, for two separately settable alarm functions. Indicators 35 and/or 36 are illuminated when the corresponding alarms are activated. For example, if alarm 1 is activated, the corresponding alarm 1 indicator 35 will also be illuminated. However, if alarm 2 is not activated, the corresponding alarm 2 indicator 36 will not be illuminated.

Display 33 also has a PM indicator 38 to indicate that the displayed time is PM when the indicator 38 is illuminated. Otherwise, it is assumed that the displayed time is AM.

Display 33 is disposed in a generally rectangular frame 40 which may be an integral part of a housing 41 of the RCC 31. Alternately, frame 40 may be a separate piece that fits together with other housing portions of housing 41. Frame 40 and housing 41 may, for example, be fabricated by injection molding with thermoplastics, or may be formed by other techniques with any other suitable materials. Housing 41 encloses the electronic circuitry which controls display 33. This circuitry will be presented more fully below.

A second generally oval or elliptical display 43 may be disposed on the front of the RCC below display 33. Display 43 is preferably of the same LED type as display 33. Display 43 includes a signal reception indicator, such as an icon 44. In this example, icon 44 is shaped to resemble a radio tower with transmitted waves radiating from the top of the tower.

In accordance with one aspect of the present invention, if RCC 31 has recently succeeded in decoding the time signal from radio station WWVB and has synchronized the time displayed by the digits 34 on display 33 to the decoded time, icon 44 will remain continuously illuminated. If RCC 31 is currently in the process of receiving and decoding a time signal, icon 44 will continuously flash until synchronization of the time occurs. For example, the flash rate may be in the range of one-half second to two seconds. However, if RCC 31 has been unable to decode a time signal, icon 44 will not be illuminated. Failure to decode a time signal may be due to poor signal reception. These various illumination conditions of icon 44 are also illustrated in FIG. 9.

If the RCC 31 fails to decode a time signal from the low frequency signal from radio station WWVB upon initial power on, RCC 31 will continue to search for a decodable signal for 20 minutes. If still unsuccessful, RCC 31 will retry for 20 minutes during each of the next two hours. Thereafter, RCC 31 will retry for 20 minutes once every three hours.

When RCC 31 successfully decodes a time signal and displays the current time, RCC 31 occasionally updates the time to insure accuracy. For example, RCC 31 may update the time during the evening hours when a stronger time signal is usually present. To this end, RCC 31 may automatically receive and decode the time signal at 1 PM, at 3 PM and again at 5 PM. If these updates are unsuccessful, RCC 31 will try again every three hours, for example.

Figure 2:
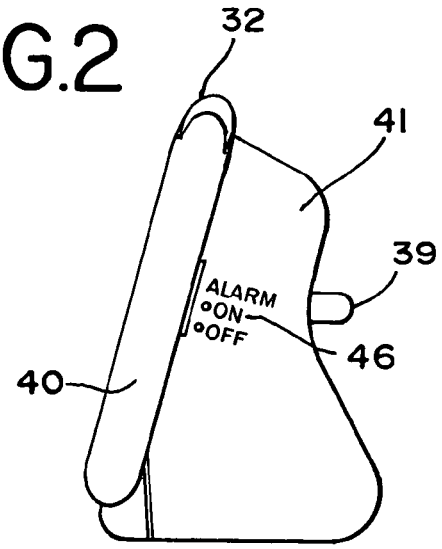
FIG. 2 is a side elevational view of one side of the RCC illustrated in FIG. 1.

With reference to FIG. 2, an alarm on/off switch 46 may be disposed on the back of the RCC 31. In this instance, switch 46 is disposed on the backside of the frame 40. An audible alarm will typically last for about two minutes. The audible alarm may be terminated at any time by moving alarm on/off switch 46 to the off position. Moving alarm on/off switch 46 back to the on position will reset the alarm for the next day.

Figure 3:
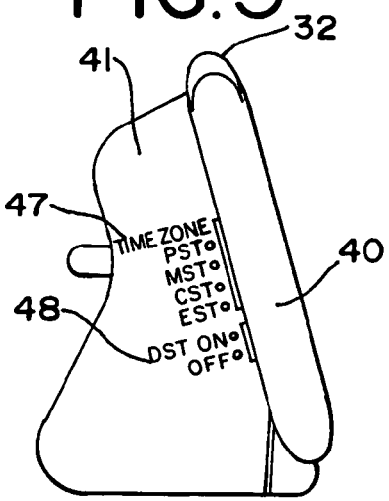
FIG. 3 is a side elevational view of the other side of the RCC illustrated in FIGS. 1 and 2.
Figure 4:
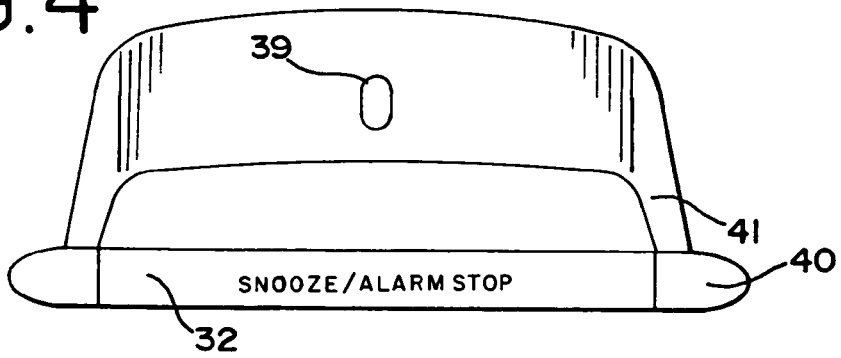
FIG. 4 is a top plan view of the RCC illustrated in FIGS. 1 through 3.

As shown in FIG. 3, a time zone switch 47 is disposed on the back of RCC 31, such as on the backside of frame 40. Switch 47 may be set to PST for Pacific Standard Time, MST for Mountain Standard Time, CST for Central Standard Time or EST for Eastern Standard Time. Setting of switch 47 to the proper time zone will enable the electronics in housing 41 to calculate and display the proper time. The only time signal transmitted by radio station WWVB from Fort Collins, Colo. is the current Greenwich Mean Time (GMT). To display the correct time, the RCC must convert the decoded GMT time into the local United States time for the applicable time zone, as set by switch 47.

Also provided on the backside of frame 40 in FIG. 3 is a Daylight Savings Time (DST) on/off switch 48. Switch 48 similarly compensates for Daylight Savings Time. While most states in the United States go onto DST for a portion of the year, certain states such as Arizona and Indiana do not. Thus, DST switch 48 should remain in the off position for those states or jurisdictions that do not go onto DST. When DST switch 48 is first moved to the on position for those states where DST is applicable, the DST ON indicator 50 will not illuminate until RCC 31 successfully decodes a time signal. During those portions of the year when DST is in use, the WWVB radio signal also provides information with the time signal that DST is now being employed.

Once the DST ON indicator 50 becomes illuminated after a successful time decode, it will remain illuminated unless the user manually sets the time by pressing the time set button 71 and the hour set button 73 or the minute set button 74. Of course, DST ON indicator 50 also ceases to be illuminated when DST is no longer in force, i.e., when the time returns to standard time.

If operating in a state that uses DST, setting of switch 48 to the DST position will cause indicia 50 on display 43 to illuminate the legend "DST ON". This DST ON indicia 50 may be seen in FIGS. 1, 5 and 9.

Disposing switches 46, 47 and 48 on the backside of the frame 40 enables easy and convenient one hand operation by the user. For example, the user can place a thumb of his/her hand against the front surface of frame 40 and then use one of the fingers of the same hand to change the position of one of the switches 46, 47 or 48 on the backside of frame 40. The switch that is likely to be used most frequently is the alarm on/off switch 46 since the time zone and DST settings of switches 47 and 48 are likely to be infrequently changed after their initial setting. Of course, if RCC 31 is used as a travel clock, then the settings of switches 47 and 48 may change depending upon the time zone and the applicability of DST.

Figure 20:
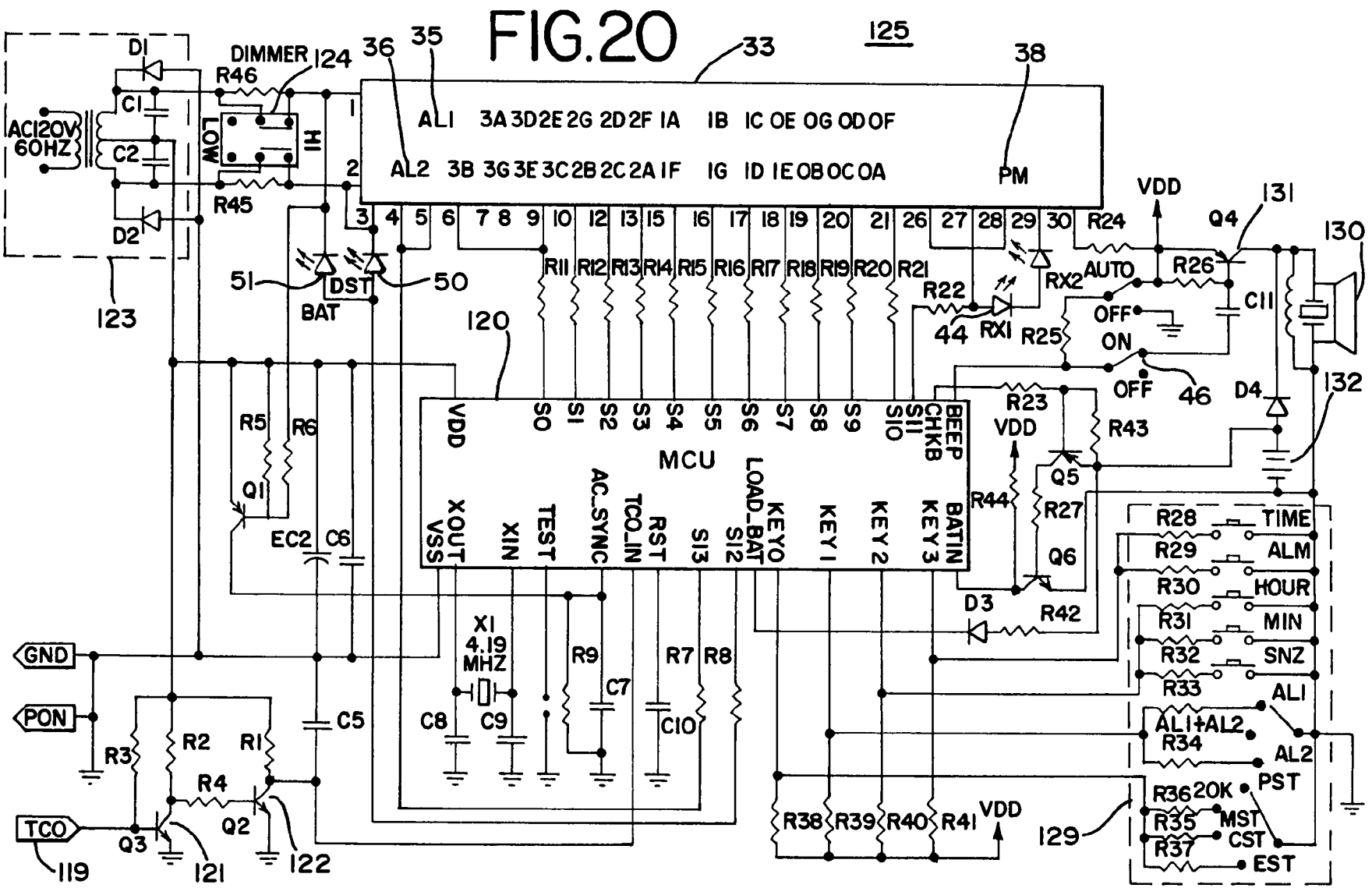
FIG. 20 is a circuit diagram of the logic portion of the electronic circuitry utilized by the RCC embodiment illustrated in FIGS. 1 through 5.

As seen in FIGS. 1, 5 and 6, display 43 also has "LOW BATT" indicia 51 to indicate when a backup battery 132 in FIG. 20 needs replacement. While the RCC 31 is intended to normally operate from AC power, any temporary interruption in the AC power could cause loss of the displayed time. RCC 31 would then need to resynchronize with the time signal. Use of a backup battery 132 will help avoid the loss of time, and the need to resynchronize, for most temporary AC power outages. The backup battery 132 may be, for example, of the commonly available nine-volt alkaline variety.

RCC 31 in FIG. 1 may have a cover panel 69 disposed below display 33 and around display 43. Cover panel 69 may be opened or removed to provide access to a plurality of switches and controls, which can be seen in FIG. 5. Depressing a time set button 71 enables the time to be set by also pressing an hour button 73 or a minute button 74. Similarly, depressing alarm set button 72 and hour button 73 or minute button 74 enables setting of the alarm. An alarm selector switch 75 is selectively movable to one of three positions to select alarm 1, alarm 2 or both alarm 1 and alarm 2. Two alarms are often desirable since a husband and a wife may wish to be awakened at different times. Two alarms may alternatively be used to provide a first alarm time during the workweek and a second alarm time during the weekend.

Figure 12:
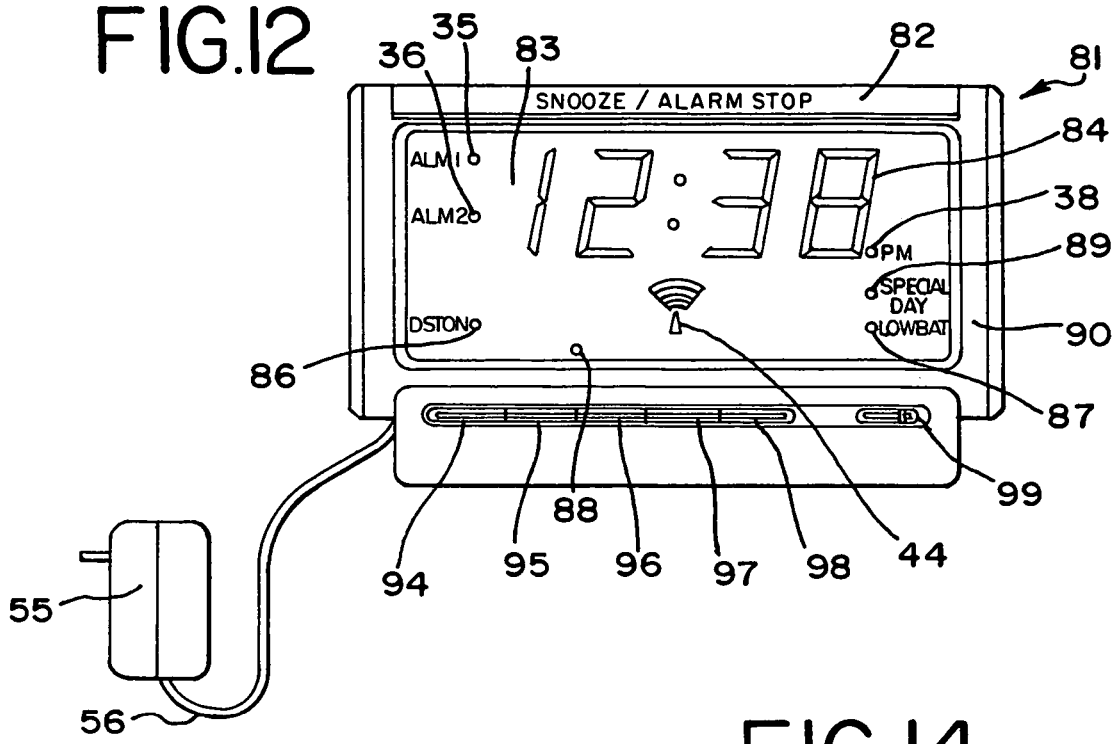
FIG. 12 is a front elevational view of a second embodiment of a radio-controlled clock that incorporates features of the present invention.
Figure 13:
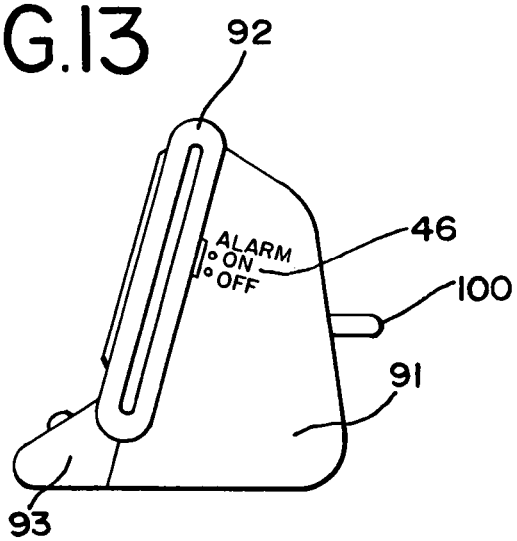
FIG. 13 is a side elevational view of one side of the RCC illustrated in FIG. 12.
Figure 19:
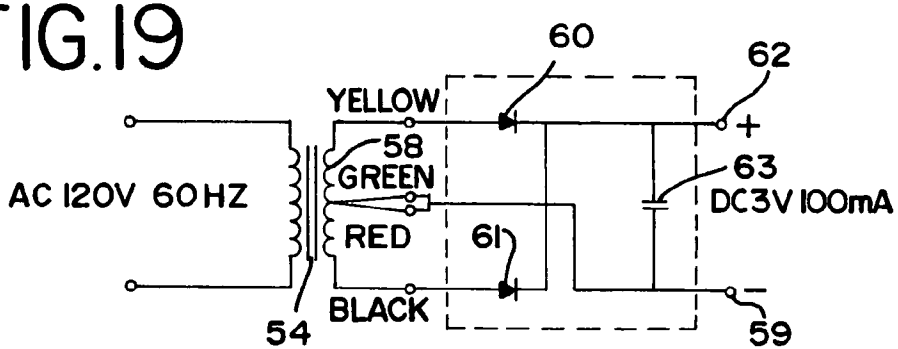
FIG. 19 is a circuit diagram of the power transformer portion of the combination power transformer and electrical plug illustrated in FIG. 18.
Figure 18:
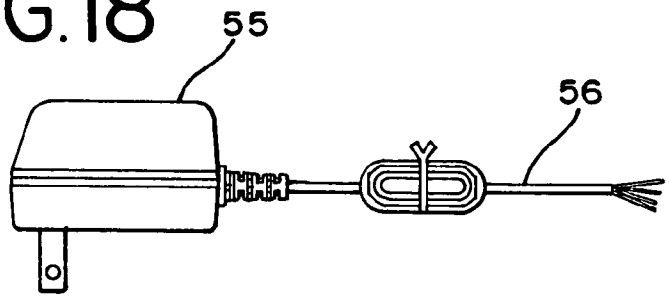
FIG. 18 is a side elevational view of a combination power transformer and electrical plug utilized by both embodiments of the RCC illustrated in FIGS. 1 through 5 and 12 through 15.

An AC power transformer 54 in FIG. 19 is housed in a combination electrical plug and power adaptor 55, as seen in FIGS. 1, 12 and 18. In accordance with another aspect of the present invention, the power transformer 54 is provided at the end of the power cord 56 to keep the transformer 54 remote from the electronic circuitry in housing 41 of the RCC 31. This assists in keeping electromagnetic radiation generated by transformer 54 from interfering with the sensitive circuitry that needs to periodically decode the time signal. For example, if the RCC can successfully synchronize to the radio signal from radio station WWVB at a signal strength of 40 dbuv/meter (this is equal to 100 microvolts/meter in actual WWVB field strength), it can be predicted that the RCC will be capable of successfully decoding and synchronizing to the radio signal in every part of the United States at midnight in the Central Time zone, i.e., at 0600 UTC (Universal Time), according to the NIST. However, it has been found that if transformer 54 is within about 5 cm of the antenna 116, the RCC is likely to fail to successfully decode the radio signal at a strength of 40 dbuv/meter since the noise from the transformer increases and the signal-to-noise ratio is reduced. Testing also confirms that good decoding performance does not result at 38 dbuv/meter until the power transformer 54 is greater than 12 cm away from the antenna 116 and the associated receiver circuitry 115. Thus, since the housings of the RCCs 31 and 81 are of relatively compact size, locating the transformer away from the housing, which includes the antenna and receiver circuitry, such as in the line cord 56 and preferably at the distal end thereof as part of the adaptor 55, yields significantly improved operation of the RCC in decoding and synchronizing to the radio signal.

Adaptor 55 also includes additional circuitry shown in FIG. 19. A secondary winding 58 of the transformer is center-tapped and brought out as the ground or negative lead at terminal 59. A pair of diodes 60 and 61 rectifies the AC signal in their respective portions of the secondary winding 58 to provide a positive voltage at terminal 62. A capacitor 63 filters the rectified voltage.

Figure 17:
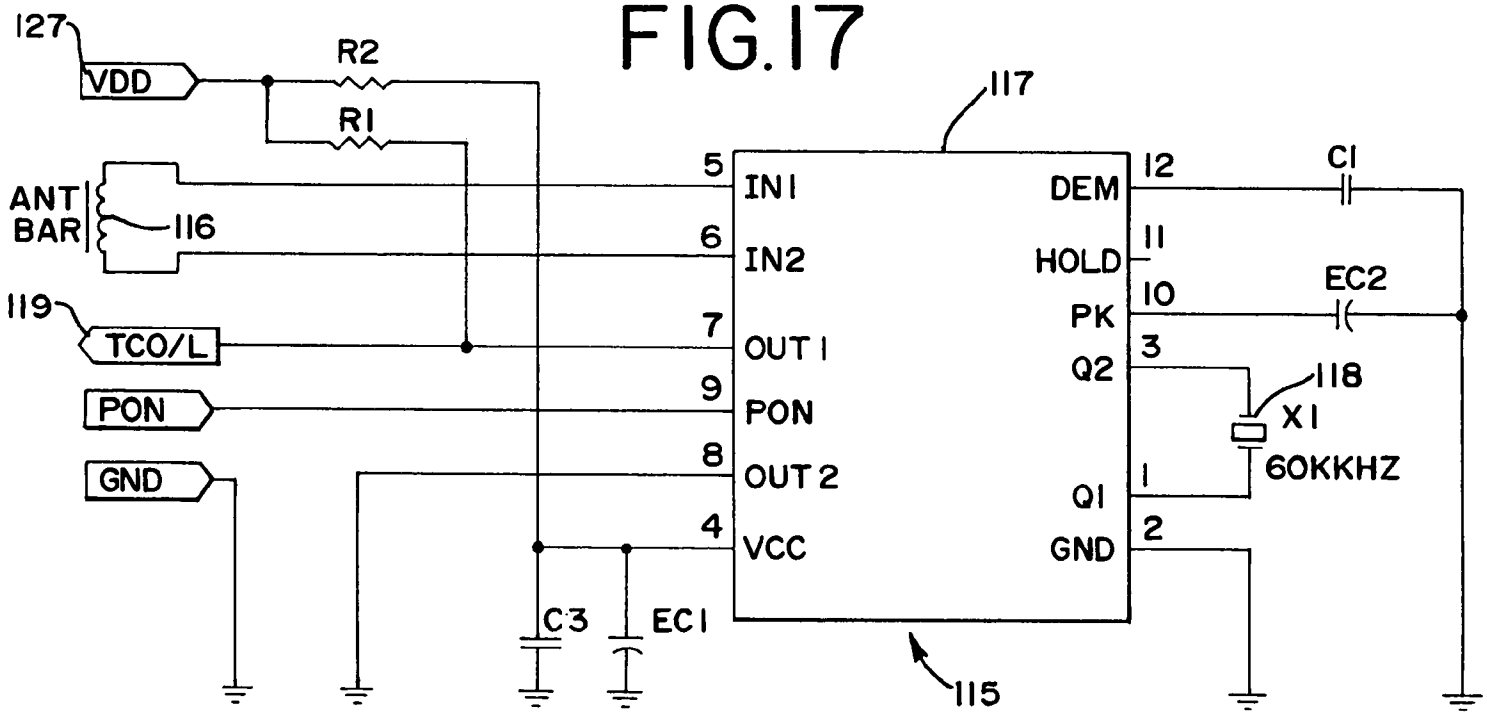
FIG. 17 is a circuit diagram of the receiver and decoder portion of the electronic circuitry utilized by both embodiments of the RCC illustrated in FIGS. 1 through 5 and 12 through 15.

In accordance with yet another aspect of the present invention, the strength of the time signal from radio station WWVB may be displayed to the user. If the signal strength is weak, relocating or repositioning the RCC 31 can often improve the signal. For example, rotating the RCC 31 with respect to the direction of the WWVB transmitter in Fort Collins, Colo. may improve the strength of the signal received by an internal antenna 116 inside the RCC. Antenna 116 is shown in FIG. 17. Similarly, relocating RCC 31 away from metal objects or near a window, may significantly improve the quality of the received signal. Of course, the ability of the RCC 31 to decode the time signal increases with better quality signals.

To assist the user in maximizing the strength of the received time signal, one of the time digits may be utilized. As seen in FIG. 8, the least significant hour digit and both minute digits have three horizontal segments. These segments may be selectively used to indicate the signal strength. Using the examples in FIG. 8 with the least significant hour digit, illumination of all three horizontal segments in the depiction 65 corresponds to a strong time signal. Illumination of two horizontal segments, as in depiction 64, corresponds to medium signal strength. Illumination of only one horizontal segment indicates weak signal strength, as shown in depiction 67. If none of the horizontal segments is illuminated as illustrated in FIG. 68, there is no signal or the signal is too weak to be useful. This exemplary display of the signal strength provides useful information to assist the user in improving the performance of the RCC 31. For example, the user can relocate or reposition the RCC and then easily compare the strength of the received signal in the new location or position to that of the prior location or position.

Of course, other alternatives exist for utilizing the display to indicate signal strength, such as by using one segment from each of the plurality of digits, or any subset thereof. Yet another alternative for displaying signal strength is to use three separate LED indicators, such as illumination of all three indicators for a strong signal, two indicators for a medium signal and one indicator for a weak signal.

Turning now to FIGS. 12 through 15, a second embodiment of a radio-controlled clock, generally designated 81, is illustrated. RCC 81 is also has alarm functions. A snooze/alarm stop button 82 may be used to terminate and temporarily reset the alarm. Snooze/alarm stop button 82 is disposed along the upper side of an enlarged and generally rectangular frame 90. Frame 90 forms a front portion of the housing 91. Frame 90 may be equipped with decorative end pieces 92 at both sides of the frame.

A display 83 is disposed in the frame 91 to display the time, such as by a plurality of digital numerals 84. As with display 33 for the RCC 31 illustrated in FIGS. 1 through 5, display 83 has time indicating numerals 84 and other indicia of the LED type. In this embodiment, the numerals 84 may be of a smaller and more conventional size than the numerals 34 in RCC 31, such as 0.9 inches (2.29 centimeters).

The LED portions of display 83 are preferably of the "high red" type, such as of the GaAlAs type, for improved and excellent visibility under virtually all normally encountered lighting conditions. A rotary dimmer switch 100 may be disposed through housing 91 on the backside of RCC 81 to provide control of the brightness of LED display 83 at any selected brightness level between maximum and minimum levels.

Similar to the display 33 of RCC 31, display 83 of RCC 81 has an alarm 1 indicator 35, an alarm 2 indicator 36 and a PM indicator 38. These indicia operate as previously described with respect to RCC 31.

Some of the indicia previously found in the second display 43 of RCC 31 are now incorporated into the display 83 of RCC 81. The RCC signal reception icon 44 is now within display 83, and operates as previously described. A DST on/off indicator 86 is now an LED, with a legend "DST ON" to indicate that DST is on when the indicator 86 is illuminated. DST indicator 86 operates similarly to the DST ON indicator 50 of RCC 31, as described above. A low backup battery indicator 87 is an LED that is illuminated when the backup battery needs replacement. Both of these LED indicators 86 and 87 are now also located within the common display 83.

Disposed near the bottom edge of display 83 is a plurality of calendar indicators 88, to indicate the day of the week. A separate indicator 88 is provided for each day of the week, Sunday through Saturday. Electronic circuitry, which will be discussed below, illuminates that LED associated with the present day of the week. These calendar indicators 88 may be an optional feature.

Display 83 also includes a special day indicator 89. The special day may be set to someone's birthday, to a wedding anniversary or to a day of the month when an important payment is due, such as on a reoccurring monthly day when a mortgage payment or a credit card payment must be paid. When set, the LED associated with special day indicator 89 will remain lit to assure the user that the special day has been successfully entered. When the special day arrives, the LED associated with indicator 89 will continuously flash to remind the user that the special day has arrived. The rate of flashing may be in the range of one-half to two seconds. When the special day arrives, RCC 81 will also provide a pleasant audible sound for a fixed period of time, such as about 15 seconds. For example, this special day sound may be provided at each hour between 9 AM and 9 PM.

A portion of housing 91 may project forwardly under display 83 to form a base or console 93 with a plurality of control buttons and switches. A time set button 94 is used in conjunction with an hour set button 97 and a minute set button 98 to set the time. An alarm set button 95 is used in conjunction with hour and minute buttons 97 and 98 and an alarm selector switch 99 to set alarms 1 and 2. The operation of buttons 94, 95, 97 and 98 and switch 99 for RCC 81 is similar to those previously described for the corresponding buttons 71 through 74 and switch 75 of RCC 31 shown in FIG. 5.

Figure 14:
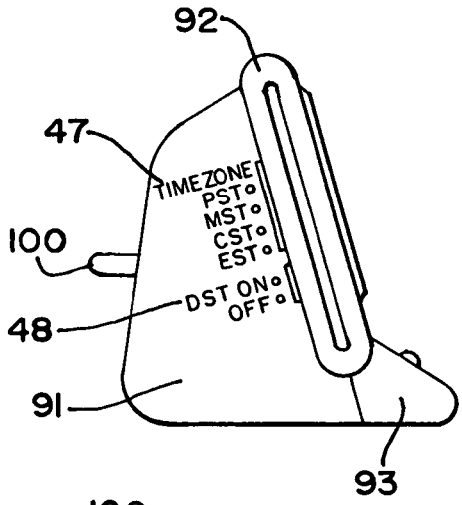
FIG. 14 is a side elevational view of the other side of the RCC illustrated in FIGS. 12 and 13.
Figure 15:
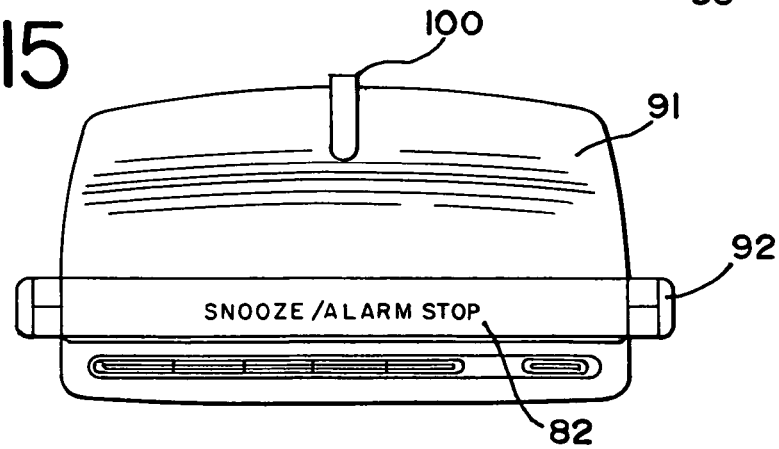
FIG. 15 is a top plan view of the RCC illustrated in FIGS. 12 through 14.

Similar to RCC 31, RCC 81 has an alarm on/off switch 46 disposed on the backside of frame 90 (FIG. 13) and a time zone set switch 47 and a DST on/off switch 48 also disposed on the backside of frame 90 (FIG. 14). Operation of switches 46 through 48 are similar the corresponding switches previously described above for RCC 31.

As discussed above with respect to frame 40 of RCC 31, when frame 90 is oversized compared to the housing 91, and when the switches 46, 47 and 48 are disposed on the backside of frame 90, the user may conveniently operate these switches with one hand.

RCC 81 has its power transformer 54 (FIG. 19) housed in the combination plug and power adaptor 55 at the end of the power line cord 56. This arrangement was described above for RCC 31 and is for the same purpose, i.e., to keep electromagnetic radiation generated by power transformer 54 remote from the electronic circuitry in the interior of housing 91. As with RCC 31, RCC 81 contains similarly sensitive circuitry for decoding the time signal from radio station WWVB.

Having now described the structure and functions of two different embodiments of the radio-controlled clock, RCC 31 and RCC 81, the methods of programming certain functionalities into these RCCs will now be presented.

To set the time zone: Slide time zone switch 47 to the appropriate time zone; PST, MST, CST or EST. Slide DST switch 48 to the on position for those jurisdictions that use DST. Otherwise, DST switch should be in the off position. The DST indicator 50 or 86 will not illuminate until a time signal from radio station WWVB has been decoded.

To set the time: Both RCCs will normally automatically receive and decode the time signal. However, in those locations where the time signal is weak during the daylight hours, it may be necessary to manually set the clock until it can receive a stronger time signal during the evening hours. To set the hour, press and hold the time set button 71 or 94 while also pressing the hour button 73 or 97. To set the minute, press and hold the time set button 71 or 94 while also pressing the minute button 74 or 98. Releasing the time set button 71 or 94 causes the display 33 or 83 to display the set time. If the set time is incorrect, the correct time will be displayed when the RCC 31 or 81 successfully decodes the time signal.

To set the calendar (when provided, such as for RCC 81): The time digits 84 of display 83 are converted to displaying a year by pressing the time set button 94 and pressing the snooze button 82 once. Thereafter, the hour and minute buttons 97 and 98 are pressed until the desired year appears. The month and day are set by pressing the time set button 94 and then pressing the snooze button 82 twice. Thereafter, the hour button 97 is pressed until the correct month appears and the minute button 98 is pressed until the correct day appears. Releasing the time set button 94 returns the RCC 81 to the time display mode.

To observe signal strength: The first time that either RCC 31 or RCC 81 is powered up, the time digits 34 or 84 of the display 33 or 83 will read "_:00", with the digit to the left of the colon indicating the signal strength as shown in FIG. 8. If the time was previously successfully determined and RCC 31 or RCC 81 is now in the receiving mode to update the prior time determination, the signal strength can be accessed by pressing the time set button 71 or 94 once and then pressing the hour/wave button 73 or 97. If RCC 31 or RCC 81 is not presently in the receiving mode, the receiving mode may be manually initiated by pressing the hour/wave button 73 or 97.

To set alarms 1 and 2: Slide the alarm selector switch 75 or 99 to the alarm 1 position. Alarm 1 LED 35 will illuminate. Press and hold alarm set button 72 or 95 while pressing the hour button 73 or 97 to set the hour for alarm 1. Similarly, press and hold alarm set button 72 or 95 while pressing the minute button 74 or 98 to set the minute for alarm 1. The setting of alarm 2 is similar, but alarm selector switch 75 or 99 must first be in the alarm 2 position. Release of the alarm set button 72 or 95 returns the display 33 or 83 to the time display mode. The preset alarm times may be viewed at any time by pressing the alarm set button 72 or 95 with the alarm selector switch 75 or 99 in the alarm 1 position for alarm 1 or in the alarm 2 position for alarm 2.

To set the weekday or weekend alarm (when provided, such as for RCC 81): The alarm 1 and alarm 2 functions normally operate as two separate alarm times for each day of the week provided that alarm selector switch 99 is in the alarm 1 and alarm 2 position. However, RCC 81 may be programmed to use the alarm 1 and alarm 2 functions to provide an alarm at a preset time during the week days, such as on Monday through Friday, and a different preset alarm time on the weekend days, such as on Saturday and Sunday. If all seven of the daily LEDs 88 on display 83 are illuminated, such as at the depiction 102 in FIG. 11, alarm programming is in the above-described mode that allows programming of two separate alarms for each day. Programming of the alarms is changed to the weekday/weekend mode by pressing the alarm set button 95 and the snooze button 82. The daily LEDs 88 will then be illuminated as shown in depictions 103 and 104 depending on whether the alarm selector switch 99 is in the alarm 1 position or the alarm 2 position. Thus, RCC 81 may be programmed to provide an alarm at a first selected time during the weekdays, i.e., on Monday through Friday, and an alarm at a second selected time on the weekend, i.e., on Saturday and Sunday.

To set the special day for one day each year (when provided, such as for RCC 81): Press the special day set button 96 and press the hour set button 97 until the desired month appears. Then press the special day set button 96 and the minute set button 98 until the desired day appears. As shown in FIG. 10 at depiction 105, the special day indicator 99 will stay on to indicate that the special day has been programmed. Upon arrival of the special day, LED indicator 89 will flash as shown in depiction 106 of FIG. 10, for example, at a rate in the range of one-half to two seconds.

To set the special day for one day each month (when provided, such as for RCC 81): Press the special day set button 96 and press the hour set button 97 until the time digits 84 display "--:" Then press the special day set button 96 and press the minute set button 98 until the desired day appears. RCC 81 will then cause special day LED indicator 89 to flash upon the selected day for all months of the year.

In both special day modes, RCC 81 preferably provides a pleasant sound pattern, such as upon each hour for about 15 seconds, in addition to the continuously flashing LED 89. The special sound pattern preferably occurs at each hour from about 9 AM to 9 PM. If no special day is programmed, LED indicator 89 is not illuminated as shown in depiction 107 of FIG. 8.

Figure 16:
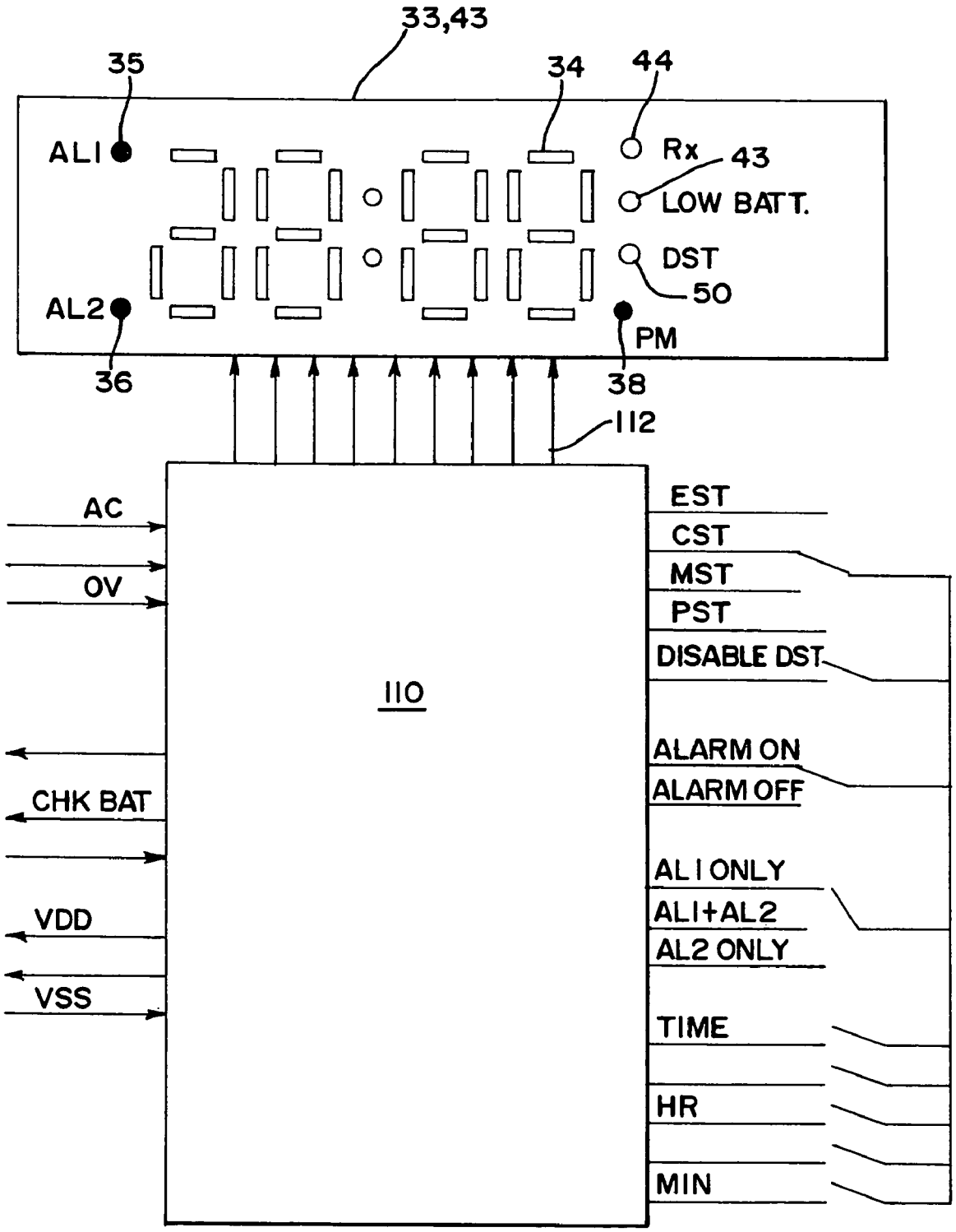
FIG. 16 is a block diagram of the electronics and display utilized by the RCC illustrated in FIGS. 1 through 5.

The electronic circuitry that controls the operation of RCC 31 is generally designated 110 in FIG. 16. Electronic circuitry 110 also controls the two displays 33 and 43, including the time digits 34, the alarm 1 and alarm 2 indicators 35 and 36, the PM indicator 38, the signal reception icon 44, the low battery indicator 43 and the DST indicator 50, via a plurality of conductors 112.

Figure 21:
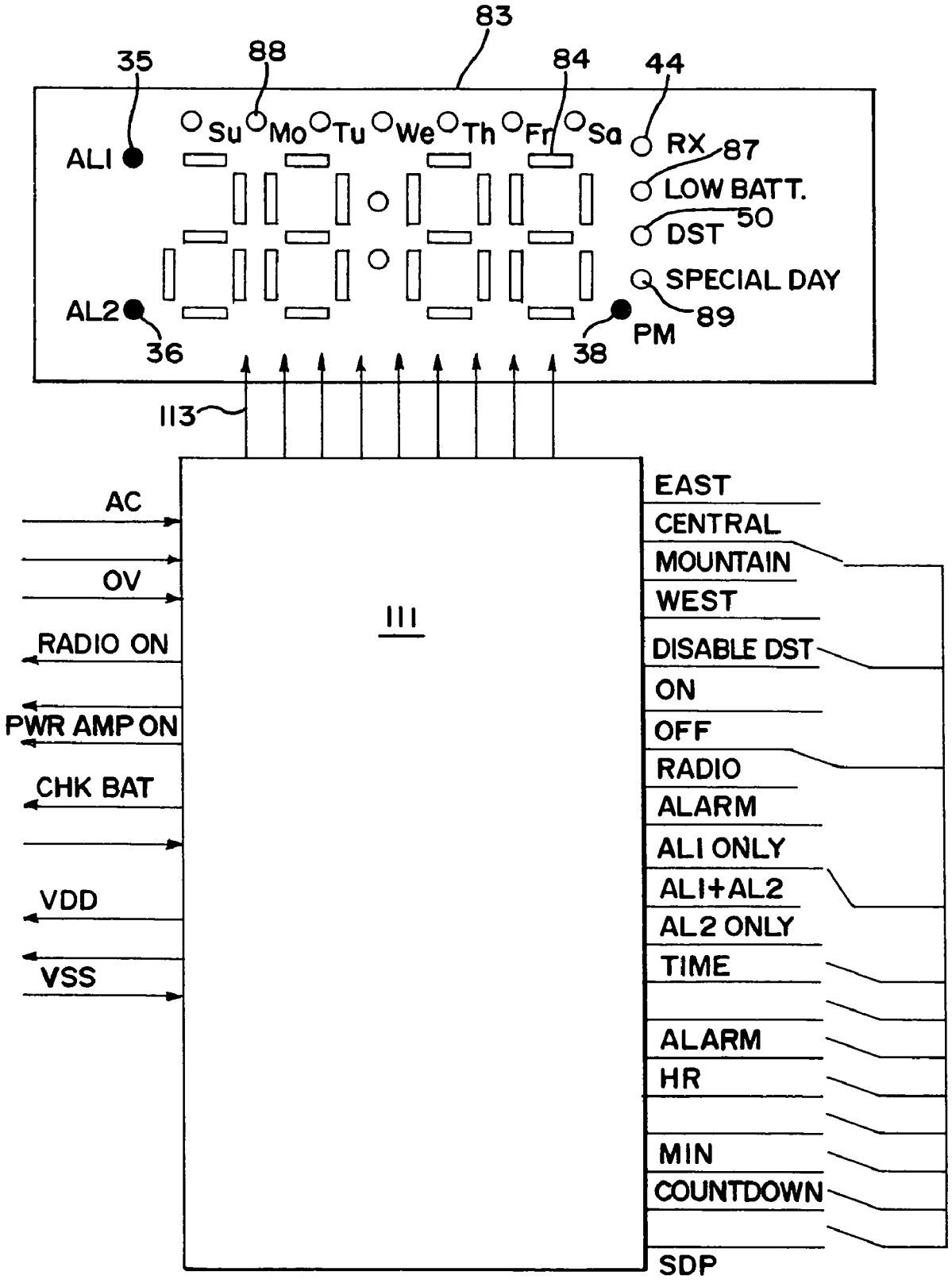
FIG. 21 is a block diagram of the electronics and display utilized by the RCC illustrated in FIGS. 12 through 15.

The electronic circuitry that controls the operation of RCC 81 is generally designated 111 in FIG. 21. Circuitry 111 is, in general, quite similar to circuitry 110 for RCC 31 with the exception of some additional functions such as the special day indicator 89 and the weekday indicators 88. Other functions, such as the ability to program alarms 1 and 2 for weekday/weekends instead of providing two alarms for each day, may reside in software differences. In a manner similar to that described for RCC 31, the circuitry 111 of RCC 81 controls the above-mentioned indicia on display 83 via a plurality of conductors 113.

FIG. 17 illustrates typical low frequency radio signal decoder circuitry, generally designated 115, for either RCC 31 or RCC 81. An antenna 116 receives the radio low frequency signal that includes current time information from radio station WWVB. This received radio signal is presented by antenna 116 to pins 5 and 6 of a decoder integrated circuit (IC) 117. A 60 KHz crystal 118 is connected across pins 1 and 3 of IC 117. Crystal 118 provides an accurate frequency reference for IC 117 to accurately decode and recover the time signal from the radio signal. The time signal is output on terminal 7 of IC 117 to a TCO terminal 119.

The lower level and logic circuitry is generally designated 125 in FIG. 20. The electronic circuitry 110 for RCC 31 in FIG. 16 consists of the decoder circuitry 117 in FIG. 17 and the lower level and logic circuitry 125 in FIG. 20. The electronic circuitry 111 for RCC 81 in FIG. 21 similarly consists of the decoder circuitry 117 and circuitry similar to the lower level and logic circuitry 125. As pointed out above, RCC 81 incorporates some additional functions, part of which are implemented in circuitry and part of which are implemented in software. Otherwise, circuitry 111 for RCC 81 bears close resemblance to the circuitry 110 for RCC 31.

Looking now at the circuitry 125 of FIG. 20, the decoded time signal from TCO terminal 119 of the decoder circuit 115 is input to lower level and logic circuitry 125 at TCO terminal 119. A pair of transistors 121 and 122 conditions the time signal. The time signal at the collector terminal of transistor 122 is presented to a microprocessor or microcontroller 120 at an input pin TCO_IN. Microcontroller 120 analyzes the time information present on the time signal to determine the current time. Microcontroller then supplies the decoded time on one or more output terminals S0 through S10 to display 33 of RCC 31.

Power to circuitry 125 is supplied by a power supply, shown within the dashed lines 123, such as to power supply terminal VDD of microcontroller 120. Power supply 123 also supplies power to the decoder circuitry 115, such as at VDD terminal 127. As previously discussed, power supply 123 is preferably located in the AC plug and adaptor 55 of FIGS. 1, 12 and 18. Power supply 123 may alternately comprise the circuitry shown in FIG. 19, such as for RCC 81.

A dimmer switch 124 preferably is inserted in series between power supply 123 and display 33 to control the brightness of the display. As shown in FIG. 20, dimmer switch 124 has two positions, HI and LOW. As previously described, dimmer switch 124 could alternatively be variable between HI and LOW positions, such as the dimmer switch 100 in FIGS. 13 through 15 to provide a continuously variable dimmer function for display 33.

A plurality of switches within the dashed lines 129 provides user inputs to input terminals KEY0 through KEY 3 of microcontroller 120. These switches correspond to the above-described time set buttons 71 and 94, alarm set buttons 72 and 95, hour set buttons 73 and 97, minute set buttons 74 and 98, snooze and alarm stop buttons 32 and 82, alarm selector switches 75 and 99 and time zone selector switch 47.

A speaker 130 provides an audible alarm sound. When alarm switch 46 is set to the alarm or on position, BEEP terminal of microcontroller 120 provides a beeping signal through alarm switch 46 to the base of a transistor 131. Transistor 131 amplifies and provides the beeping signal to speaker 130 that sounds an audible alarm.

As previously mentioned, a backup battery 132 is connected to the electronic circuitry to provide power in the event of a power failure at the AC input to the normally operating power supply 123. In the event of an AC power failure, backup battery 132 will supply the operating power. RCC 31 will continue to execute all of its functions including displaying the current time, updating the time by occasionally decoding the time signal and providing any preprogrammed alarms. Battery 132 will typically provide backup power for more than 24 hours. Thus, throughout temporary AC power outages, RCC 31 will continue to accurately display the current time.

In the embodiment of RCC 31, the LOW BATT LED indicator 51, the DST ON LED indicator 50, and the signal reception LED indicator 44 are located on a second display 43 in FIG. 1. These LED indicators are therefore shown separate from display 33 in FIG. 20.

In many ways, the structure, features and operation of RCC 31 and RCC 81 are similar. While certain differences in structure, features and/or operation were identified between RCC 31 and RCC 81, it will be appreciated by those skilled in the art that some of these differences in RCC 81 could be incorporated into RCC 31, and vice versa. Likewise, yet another RCC could be created by selecting some of the structure, features and operation from RCC 31 and by selecting other structure, features and operation from RCC 81.

It will be understood that the embodiments of the present invention, which have been described, are illustrative of some of the applications of the principles of the present invention. Various modifications may be made by those skilled in the art without departing from the true spirit and scope of the invention.

The invention claimed is:

1. A radio-controlled clock for receiving a transmitted time signal that is related to a time standard, and for displaying a time that is decoded from the transmitted time signal, said radio-controlled clock comprising:

a housing;

a display on said housing including indicia for displaying the time of day; and electronic circuitry for receiving the transmitted time signal, decoding the transmitted time signal, and for providing a decoded time signal to the display;

said indicia on the display being of the bright light emitting diode (LED) type for displaying the time of day under all lighting conditions.

2. The radio-controlled clock in accordance with claim 1 wherein said bright light emitting diodes are of the GaAlAs type.

3. The radio-controlled clock in accordance with claim 1 further comprising a dimmer control to provide dimming of the brilliance of the bright light emitting diode display between a bright mode and a dim mode.

4. A radio-controlled clock for receiving a transmitted time signal that is related to a time standard, and for displaying a time that is decoded from the transmitted time signal, said radio-controlled clock comprising:

a housing;

a display on said housing including indicia for displaying the time of day;

electronic circuitry for receiving the transmitted time signal, decoding the transmitted time signal, and for providing a decoded time signal to the display; and a signal strength indicator for indicating the strength of the transmitted time signal as received by the electronic circuitry.

5. The radio-controlled clock in accordance with claim 4 wherein the signal strength indicator comprises a plurality of segments.

6. The radio-controlled clock in accordance with claim 5 wherein the plurality of segments for the signal reception indicator includes a segment for indicating a transmitted time signal of strong strength, a segment for indicating a transmitted time signal of medium strength, and a segment for indicating a transmitted time signal of weak strength.

7. The radio-controlled clock in accordance with claim 6 wherein the plurality of segments for the signal reception indicator further includes a segment for indicating a transmitted time signal too weak in strength to be reliably decoded.

8. A radio-controlled clock for receiving a transmitted time signal that is related to a time standard, and for displaying a time that is decoded from the transmitted time signal, said radio-controlled clock comprising:

a housing;

a display on said housing including indicia for displaying the time of day;

electronic circuitry for receiving the transmitted time signal, decoding the transmitted time signal, and for providing a decoded time signal to the display, said electronic circuitry disposed in the housing; and a transformer for converting alternating current power to a lower voltage level suitable for supplying power to said electronic circuitry, said transformer located outside of said housing such that electromagnetic fields generated by said transformer do not interfere with the operation of the electronic circuitry in decoding the transmitted time signal.

9. The radio-controlled clock in accordance with claim 8 further comprising:

a line cord including a plug for connecting to a power outlet for supplying alternating current power to the transformer and to said electronic circuitry;

said transformer disposed in said line cord.

10. The radio-controlled clock in accordance with claim 9 wherein said transformer is disposed in the line cord near said plug.

11. The radio-controlled clock in accordance with claim 8 said indicia on the display being of the bright light emitting diode (LED) type for displaying the time of day under all lighting conditions.

12. The radio-controlled clock in accordance with claim 11 said bright light emitting diodes being of the GaAlAs type.

13. The radio-controlled clock in accordance with claim 11 further comprising a dimmer control to provide dimming of the brilliance of the bright light emitting diode display between a bright mode and a dim mode.

14. A radio-controlled clock for receiving a transmitted time signal that is related to a time standard, and for displaying a time that is decoded from the transmitted time signal, said radio-controlled clock comprising:

a housing;

a display on said housing including indicia for displaying the time of day;

electronic circuitry for receiving the transmitted time signal, decoding the transmitted time signal, and for providing a decoded time signal to the display;

a special day indicator in communication with said electronic circuitry; and said electronic circuitry programmed to illuminate the special day indicator on the special day.

15. The radio-controlled clock in accordance with claim 14 further comprising:

an alarm for providing an audible alarm, said electronic circuitry causing said alarm to operate in a distinctive audible pattern upon occurrence of the special day.

16. The radio-controlled clock in accordance with claim 14 further comprising:

an indicator for providing a visible indication, said electronic circuitry causing said indicator to operate in a distinctive visual pattern upon occurrence of the special day.

* * * * *